United States Patent [19]

Schedele

[11] 4,429,292

[45] Jan. 31, 1984

[54] RETAINING PLATE FOR USE IN A MAGNET SYSTEM OF A RELAY

[75] Inventor: Helmut Schedele, Diessen, Fed. Rep. of Germany

[73] Assignee: Siemens Aktiengesellschaft, Berlin & Munich, Fed. Rep. of Germany

[21] Appl. No.: 368,452

[22] Filed: Apr. 14, 1982

[30] Foreign Application Priority Data

May 20, 1981 [DE] Fed. Rep. of Germany ..... 3120117

[51] Int. Cl.[3] ..... H01H 45/00

[52] U.S. Cl. ..... 335/202; 335/128; 335/135

[58] Field of Search ..... 335/202, 128, 131

[56] References Cited

U.S. PATENT DOCUMENTS 4,080,584 3/1978 Möeller ..... 335/135

4,316,164 2/1982 Essler ..... 335/202

FOREIGN PATENT DOCUMENTS 7909135 5/1979 Fed. Rep. of Germany .

*Primary Examiner*—Harold Broome

*Attorney, Agent, or Firm*—Hill, Van Santen, Steadman & Simpson

[57] ABSTRACT

A retaining plate for use in a magnet system of an electromagnetic relay, the magnet system having an angled yoke with a yoke leg disposed parallel to the coil axis and the yoke being secured at both sides in longitudinal grooves of a relay base, is comprised of elastic material and is disposed at the side of the yoke leg facing the coil and has a central portion supported against the yoke leg which is held at both sides in longitudinal grooves of the relay base with bent lateral tabs. The retaining plate can simultaneously serve as a separating plate with a hooked tab extending through the yoke leg and having a portion disposed between the yoke leg and the relay armature.

9 Claims, 7 Drawing Figures

RETAINING PLATE FOR USE IN A MAGNET SYSTEM OF A RELAY

BACKGROUND OF THE INVENTION

1. Field of the Invention

The present invention relates to a magnet system for an electromagnetic relay which has an angular yoke with a yoke leg disposed parallel to the coil axis, the yoke being secured at both sides in longitudinal grooves of a relay base, and in particular to a retaining plate for such a magnet system.

2. Description of the Prior Art

Magnet systems for use in electromagnetic relays are known in the art wherein the magnet system includes an angular yoke with a yoke leg which is disposed generally parallel to the coil axis and wherein the yoke leg is secured at both sides of the relay in longitudinal grooves carried in a relay base. It is known from German Utility Model No. 7909135, corresponding to U.S. Pat. No. 4,316,164 to secure the yoke leg in a recess of the relay body with a snap-in tooth. This known structure further provides a plurality of deformable ribs in the grooves of the base body in order to provide a frictional fastening and positioning of the yoke leg. Such a press fit of the yoke in the relay base, however, results in undesirable stresses in the synthetic material comprising the relay base.

It is also possible to fix the yoke in the relay base by bonding the yoke in the grooves of the base, however, the introduction of an adhesive-application step in the relay assembly process is relatively complicated because the yoke must be held in the proper position by some means until the adhesive has set.

SUMMARY OF THE INVENTION

It is an object of the present invention to provide a magnet system for an electromagnetic relay wherein the yoke is secured in the relay body in a manner which still permits the relay to be easily assembled.

The above object is inventively achieved in a magnet system for an electromagnetic relay having a retaining plate comprised of elastic material which is disposed at the side of the yoke facing the coil and which has a central portion supported against the yoke leg which is parallel to the coil axis and further has bent lateral tabs which engage longitudinal grooves in the relay base for securing and positioning the retaining plate.

The retaining plate can be manufactured and mounted as a simple stamped and bent part. Because of its inherent elasticity, the retaining plate can absorb forces occurring by virtue of the frictional securing of the retaining plate in the relay base without loading the synthetic relay base to an accessive degree. The retaining plate can be mounted together with the yoke in one assembly step by simply being plugged into the relay base. Before being plugged into the relay base, the retaining plate is preferably pre-mounted by means of lateral snap-in teeth carried on the yoke leg which engage fastening brackets formed on both sides of the retaining plate. In order to facilitate insertion of the yoke-and-retaining plate combination, the retaining plate has tabs which are bent at the lateral sides of the retaining plate in the plug-in direction of the yoke leg.

The retaining plate may additionally have at least one corner which is laterally bent opposite to the plug-in direction of the yoke and which engages a recess in the relay base.

In another embodiment, the retaining plate is secured by means of a U-shaped hooked tab formed in the central portion of the retaining plate which extends through and partially surrounds the yoke leg. In this embodiment the retaining plate may also have integral lateral legs which surround the narrow sides of the yoke leg. This embodiment of the retaining plate serves the simultaneous function of acting as a separator plate between the armature of the relay and the yoke, in which case the retaining plate is comprised of non-ferromagnetic material. Because the thickness of the plate is relatively slight, the retaining plate can be provided with stiffening ribs which are impressed in the retaining plate at right angles to the longitudinal direction of the yoke leg.

In another embodiment, the retaining plate has an extension extending toward a base of the relay having a recess in registry with a recess in the yoke leg which serves for precisely positioning an armature retaining spring. This permits the recess in the yoke, which is relatively much thicker than the retaining plate and therefore relatively more difficult in which to accurately position the recess, to be manufactured with less precision because the edges of the recess in the retaining plate, which can be more easily accurately manufactured, serve to precisely position the spring.

DESCRIPTION OF THE PREFERRED EMBODIMENTS

Figure 1:
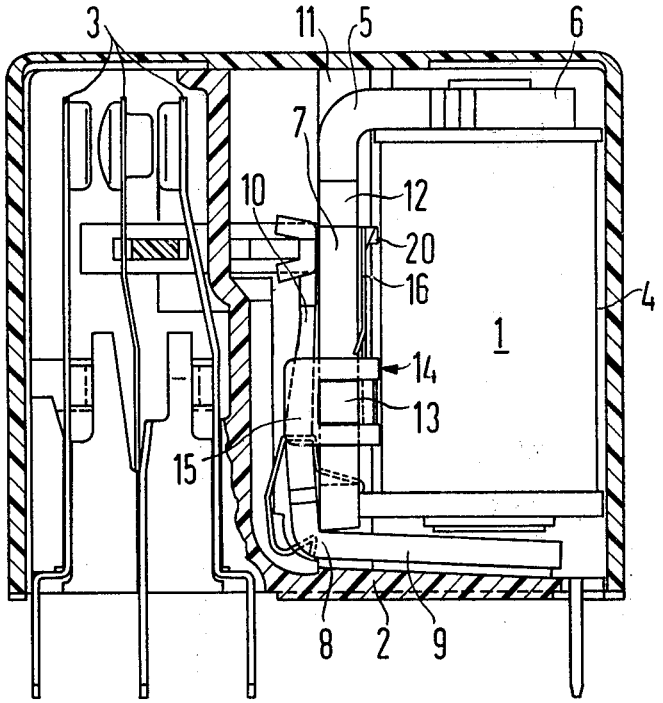
FIG. 1 is a sectional view, partly broken away, of an electromagnetic relay having a magnet system constructed in accordance with the principles of the present invention.
Figure 2:
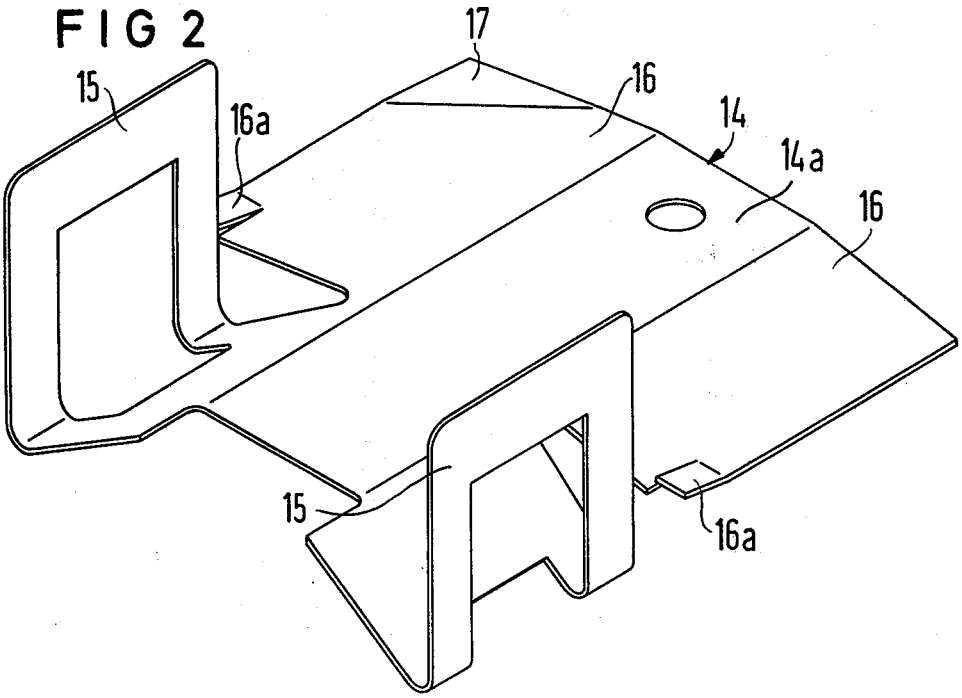
FIG. 2 is a perspective view of a first embodiment of a retaining plate used in the relay shown in FIG. 1.
Figure 3:
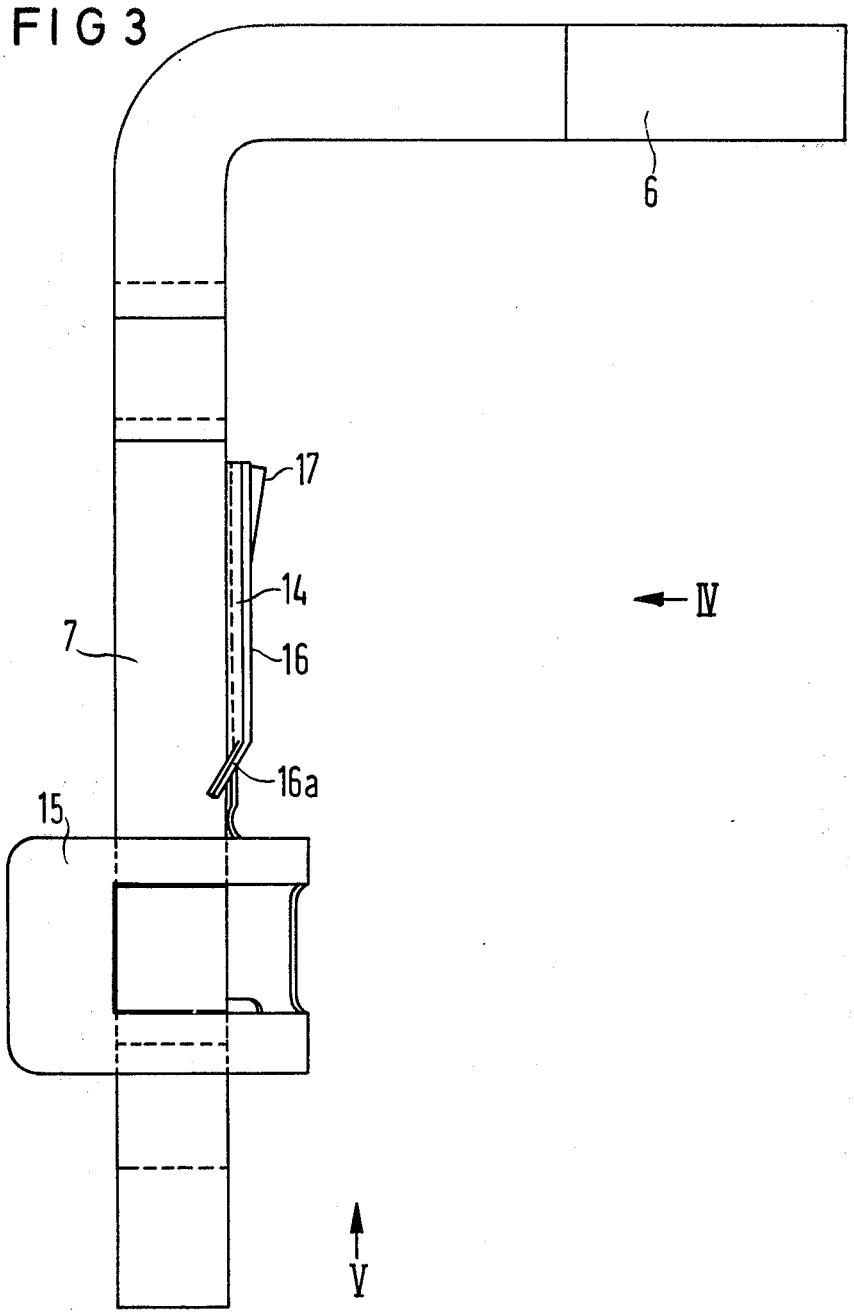
FIG. 3 is a side view of the retaining plate shown in FIG. 2 shown in position against the relay yoke.

An electromagnetic relay having a magnet system 1 constructed in accordance with the principles of the present invention is shown in FIG. 1. The relay has a relay base body 2 in which a plurality of contact springs 3 are mounted. The magnet system 1 consists of an electromagnetic coil 4, an angular yoke 5 having a horizontal yoke leg 6 and a vertical yoke leg 7, and an armature 8 having a generally horizontal leg 9 and a generally vertical leg 10. The vertical yoke leg 7 is substantially parallel to the central axis of the coil 4 and is inserted in a longitudinal groove 11 of the relay base 2 at both sides and is guided in the longitudinal grooves 11 with lateral plugs 12 and 13.

A retaining plate 14 is mounted in place with respect to the yoke 7 by means of a pair of lateral brackets 15 which engage the lower plugs 13 of the yoke leg 7 and by lateral flanges 16 which are bent with respect to a flat central portion 14*a* and which are received in the grooves 11 of the relay base 2. The shape of and means for securing the retaining plate 14 in the relay can be seen with greater clarity in FIGS. 2 through 5.

The retaining plate 14, which consists of resilient material, such as, for example, spring steel, presses against the flat side of the yoke leg 7 closest to the coil 4 with its central portion 14*a* and the lateral flanges 16 which are bent away from the yoke leg 7 serve for securing the plate 14 in the grooves 11 of the relay body 2. The retaining plate 14 is secured to the yoke leg 7 with the two brackets 15 which resiliently engage the plugs 13 of the yoke leg 7. After pre-assembly of the retaining plate 14 on the leg 7 of the yoke 5, the yoke 5 together with the retaining plate 14 are inserted into the grooves 11 of the relay base 2, with angled tabs 16*a* carried on the lower outer corners of the flanges 16 facilitating the insertion. After the yoke leg 7 has been entirely inserted in the relay body 2, the bent corner 17 of one of the lateral flanges 16 is braced in the corresponding groove 11 of the relay body 2 thereby preventing the yoke leg 7 from being pushed back. A recess 20 with which the bent corner 17 engages may be additionally provided in the relay base 2.

Figure 5:
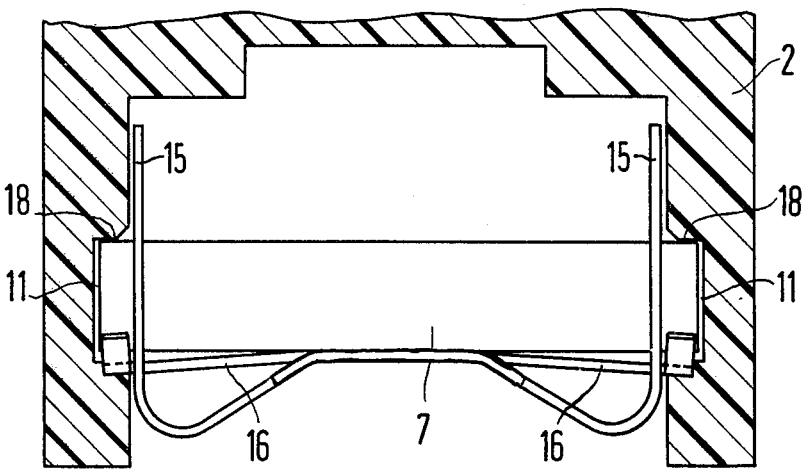
FIG. 5 is a sectional view of a portion of the relay shown in FIG. 1 as seen in the direction of arrow V in FIG. 3.

The arrangement of the yoke leg 7 and the retaining plate 14 in the relay body 2 can be seen in sectional view in FIG. 5, wherein a portion of the relay base 2 is also illustrated. The yoke leg 7 is pressed against the shoulders 18 in the grooves 11 by means of the retaining plate 14. In FIG. 5, the lateral flanges 16 are illustrated without stress.

Figure 4:
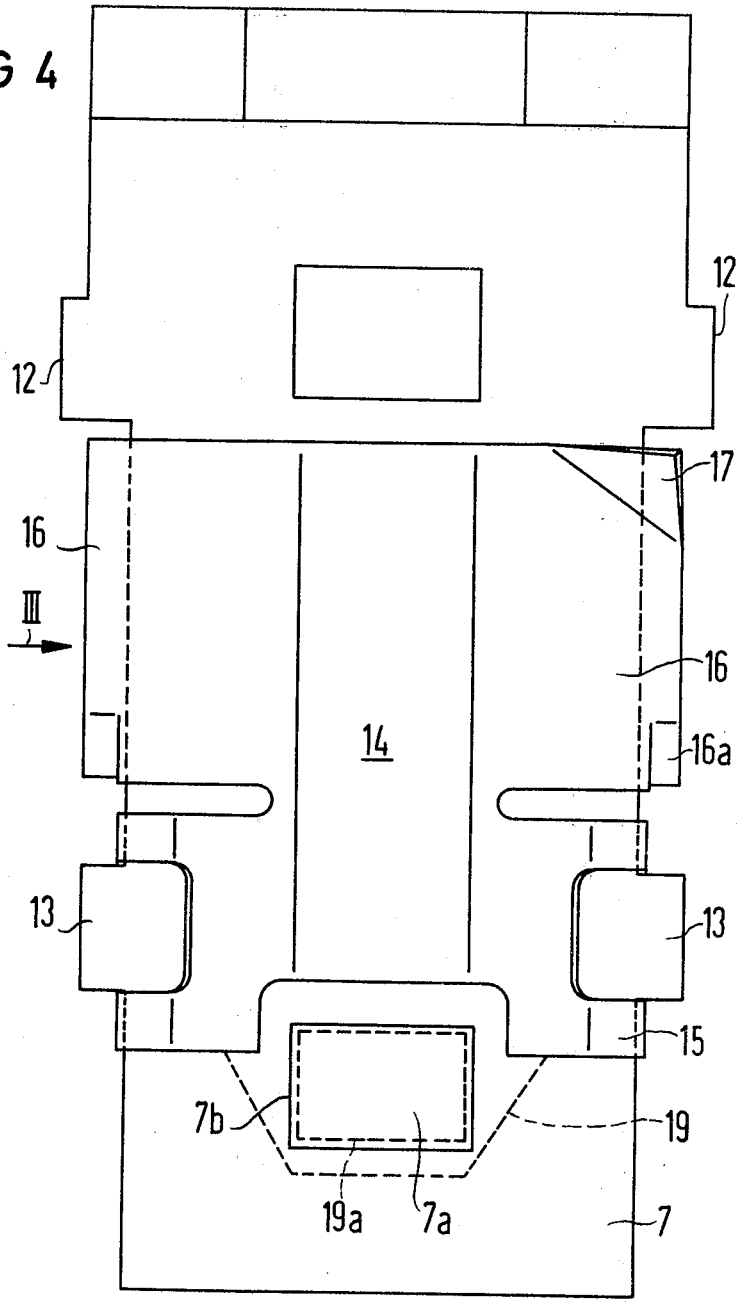
FIG. 4 is a plan view of a second embodiment of the retaining plate in position with the relay yoke.

A second embodiment for the retaining plate 14 is shown in FIG. 4, including a lower extension 19 shown in dashed lines. The extension 19 covers a recess 7*a* in the yoke leg 7 which is utilized for fastening and precisely positioning an armature retaining spring 8*a*, shown in FIG. 1. The extension 19 of the retaining plate 14 can assume this function of positioning the spring 8*a* by means of precisely cut interior contours 19*a* forming a recess in the extension 19. This permits the interior 7*b* of the recess 7*a* in the yoke leg 7 to be manufactured somewhat larger than the recess formed by the edges 19*a* in the extension 19. Because the yoke 7 is relatively thicker than the retaining plate 14, it is much easier to manufacture the recess in the retaining plate 19 than in the yoke leg 7 so that the edges of the recess in the extension 19 can be precisely positioned much more easily than the edges of the recess 7*b* in the yoke leg 7. Manufacture of the yoke 5 is thus simplified.

Figure 6:
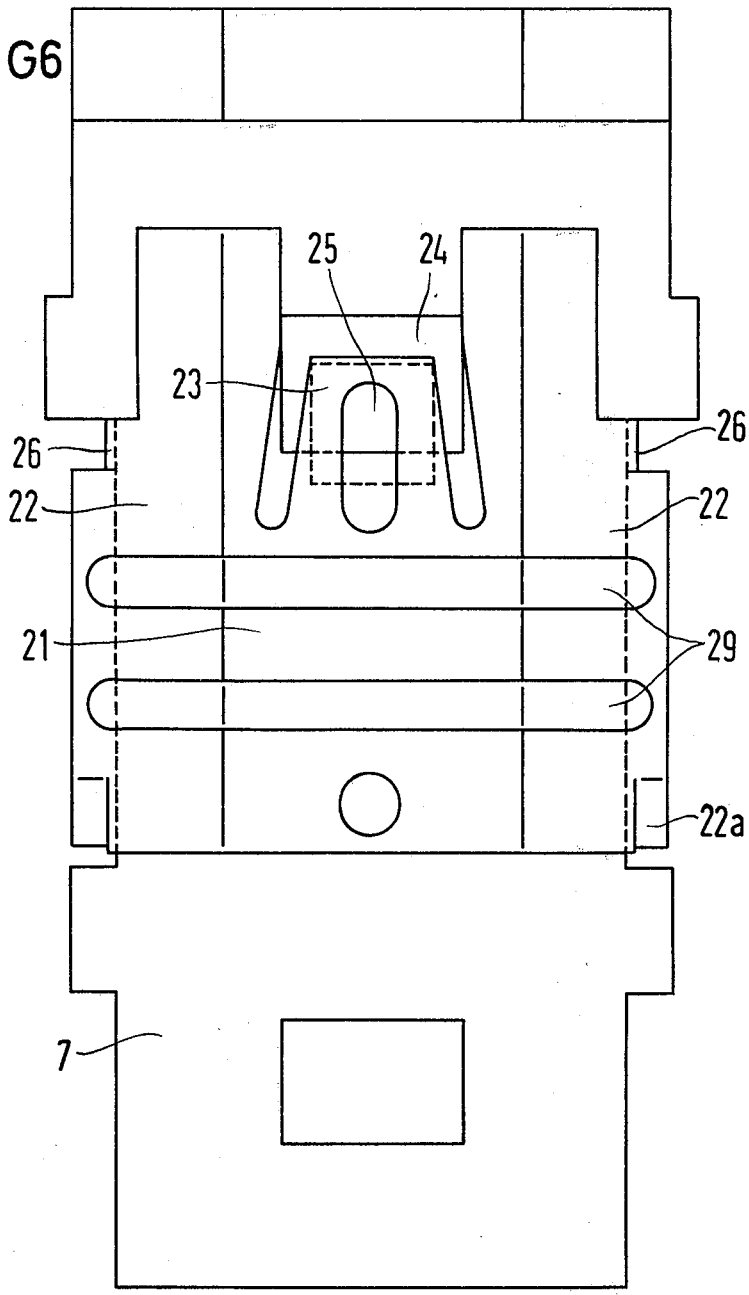
FIG. 6 is a plan view of a third embodiment of a retaining plate constructed in accordance with the principles of the present invention in place with the relay yoke.
Figure 7:
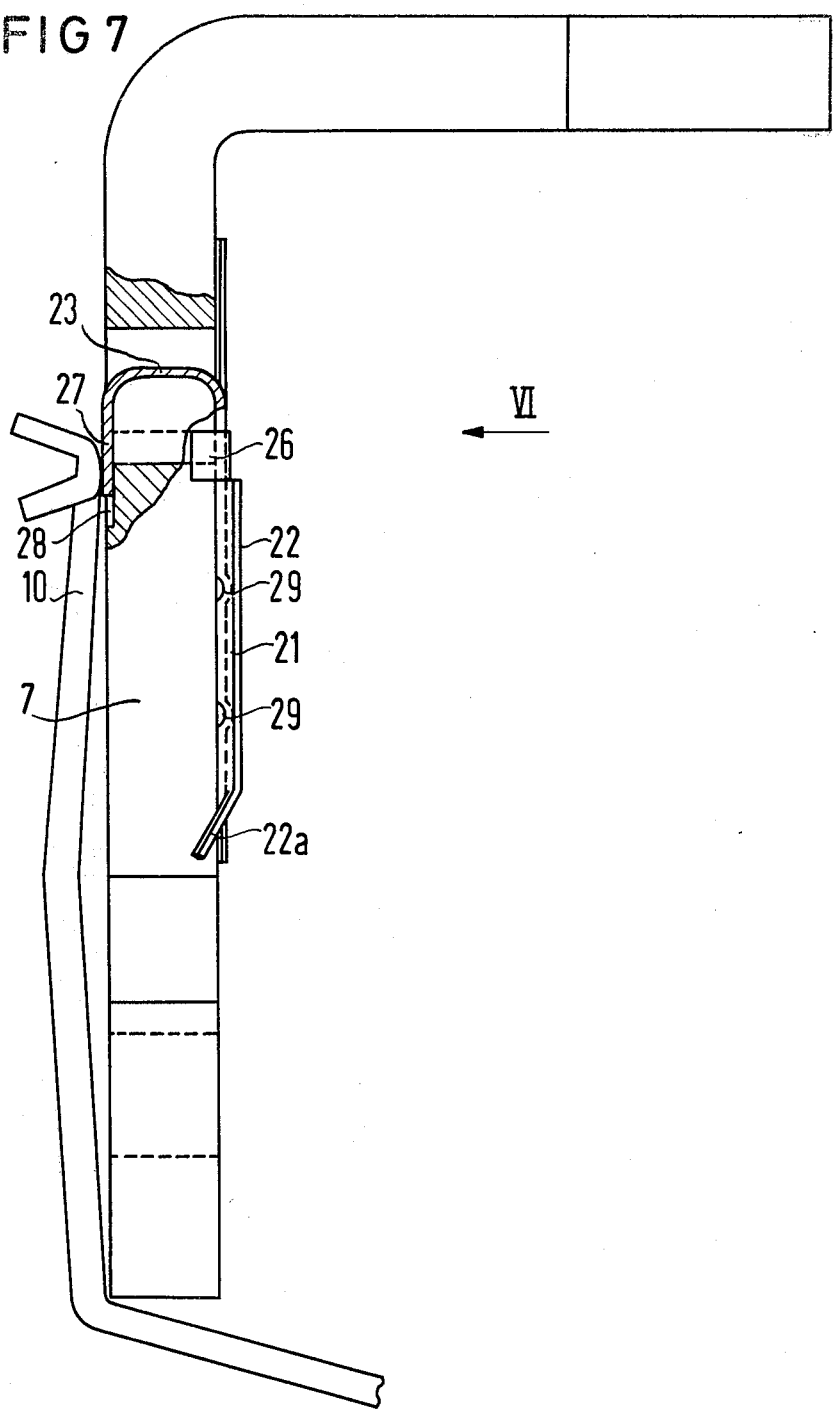
FIG. 7 is a side view of the retaining plate-yoke combination shown in FIG. 6.

A further embodiment for the retaining plate 14 is shown in FIGS. 6 and 7. In this embodiment the retaining plate 21 has lateral flanges 22 for securing the plate 21 in the relay base 2, with each flange 22 having angled tabs 22*a* at a lower portion thereof for facilitating assembly of the plate 21 with the yoke leg 7. A centrally disposed U-shaped hooked tab 23 is inserted in a recess 24 of the yoke 7 and serves to secure the plate 21 to the yoke leg 7. An opening 25 in the hooked tab 23 aids in assembly. The retaining plate 21 further exhibits lateral legs 26 which are bent at right angles to the central portion of the plate 21 and which press against the narrow sides of the yoke leg 7.

The free end 27 of the hooked tab 23 is disposed on the opposite side of the yoke leg 7 with respect to the remainder of the plate 21. The free end 27 of the hooked tab 23 can thus simultaneously serve as a separating plate for the armature leg 10 disposed at this location. For this purpose the retaining plate 21 must consist of a non-ferromagnetic material such as, for example, a copper alloy. The free end 27 may be disposed in a depression 28 in the yoke leg 7, so that the free end 27 projects as little as possible over the plane surface of the yoke leg 7. In this embodiment, the retaining plate 21 can be manufactured from relatively thin plate material and may therefore be provided with impressed ribs 29 for stiffening.

Although modifications and changes may be suggested by those skilled in the art it is the intention of the inventor to embody within the patent warranted hereon all changes and modifications as reasonably and properly come within the scope of his contribution to the art.

I claim as my invention

1. A magnet system for an electromagnetic relay comprising:

an electromagnetic coil having a central axis;

a relay base body having side walls with longitudinal grooves therein;

an angled yoke having a yoke leg parallel to said coil axis and having a plurality of pairs of lugs carried on said yoke leg received in said longitudinal grooves of said relay base body for positioning and mounting said yoke; and a retaining plate comprised of resilient metal, said retaining plate disposed between said yoke leg and said coil, said retaining plate having a central portion supported against said yoke leg and having a pair of bent lateral flanges engaged in said longitudinal grooves of said relay base body.

2. The magnet system of claim 1 wherein said retaining plate further comprises a pair of bent tabs disposed at a lower outer corner of said lateral flanges for aiding engagement of said flanges in said lateral grooves.

3. The magnet system of claim 1 wherein said retaining plate further comprises an upper corner of one of said lateral flanges which is bent for securing said retaining plate in said longitudinal grooves.

4. The magnet system of claim 1 wherein said retaining plate further comprises a pair of brackets extending from opposite sides of said central portion of said retaining plate, said brackets respectively receiving a pair of said lugs of said yoke leg.

5. The magnet system of claim 1 wherein said yoke leg has an upper recess therein and wherein said retaining plate further comprises a U-shaped hooked tab extending through said upper recess in said yoke leg for securing said retaining plate thereto.

6. The magnet system of claim 5 wherein said retaining plate further comprises a pair of lateral legs disposed at opposite sides of said retaining plate which surround said yoke leg for securing said retaining plate thereto.

7. The magnet system of claim 5 wherein said magnet system further comprises an armature having an armature leg disposed substantially parallel to said yoke leg, and wherein said retaining plate consists of non-ferromagnetic material and further comprises a free end of said hooked tab disposed adjacent to a side of said yoke leg away from said coil for serving as a separating plate between said armature leg and said yoke leg.

8. The magnet system of claim 5 wherein said retaining plate further comprises a plurality of stiffening ribs impressed in said retaining plate at right angles relative to said yoke leg.

9. The magnet system of claim 1 wherein said magnet system further comprises an armature spring and wherein said yoke leg has a lower recess for mounting and positioning said armature spring, and wherein said retaining plate further comprises a lower extension having a recess therein in registry with said lower recess of said yoke leg, said recess in said lower extension of said retaining plate being slightly smaller than said lower recess of said yoke leg.

* * * * *